United States Patent [19]

Kopf, deceased et al.

[11] Patent Number: 4,705,200

[45] Date of Patent: Nov. 10, 1987

[54] PIVOT-LOAD POWDER ACTUATED TOOL WITH FIRING CHAMBER INSERT

[75] Inventors: Rowland J. Kopf, deceased, late of Southington, by Virginia G. Kopf, heiress; William C. Flynn, Northford, all of Conn.

[73] Assignee: Uniset Corporation, Indianapolis, Ind.

[21] Appl. No.: 699,808

[22] Filed: Feb. 8, 1985

[51] Int. Cl.[4] ..... B25C 1/10; B25C 1/12; B25C 1/18

[52] U.S. Cl. ..... 227/9; 227/8

[58] Field of Search ..... 227/8, 9, 156, 8–10

[56] References Cited

U.S. PATENT DOCUMENTS

| | | | |
|---|---|---|---|
| 3,047,873 | 8/1962 | Schulz | 227/9 |
| 3,323,705 | 6/1967 | Grotsch et al. | 227/10 |
| 3,563,439 | 2/1971 | Pomeroy | 227/10 X |
| 4,282,714 | 8/1981 | Fiocchi | 227/9 X |

FOREIGN PATENT DOCUMENTS

| | | | |
|---|---|---|---|
| 1930661 | 7/1978 | Fed. Rep. of Germany | 227/9 |
| 0772352 | 4/1957 | United Kingdom | 227/9 |
| 0799443 | 8/1958 | United Kingdom | 227/9 |
| 0919861 | 4/1982 | U.S.S.R. | 227/9 |

*Primary Examiner*—Howard N. Goldberg

*Assistant Examiner*—Taylor J. Ross

*Attorney, Agent, or Firm*—William W. Jones

[57] ABSTRACT

This powder actuated tool is designed to fire high power loads, such as 32 caliber blanks, to drive a member into a concrete surface. The tool has a housing and a reciprocating barrel mounted on the housing. The firing mechanism is contained in a breech block which is reciprocable in the housing. The cartridge chamber is disposed in the breech end of the barrel in a member which is freely slidably removable from the barrel in a breechward direction. The member is provided with empty external gas sealing grooves which prevent substantial breechward movement of the cartridge chamber member when the tool is fired. There is no mechanical lock between the breech block and the breech end of the barrel. Reciprocal movement of the barrel is controlled by guide lugs on the muzzle end of the housing and mating guide slots formed in the exterior of the barrel. The lugs and mating slots allow longitudinal and pivotal movement of the barrel assembly between breech closed and breech open positions and also allow rotational movement of the barrel when in its breech closed position. The rotational movement is required before the tool can be cocked for firing. The slots also allow the barrel assembly to be completely removed from the housing without the use of any special tools.

21 Claims, 15 Drawing Figures

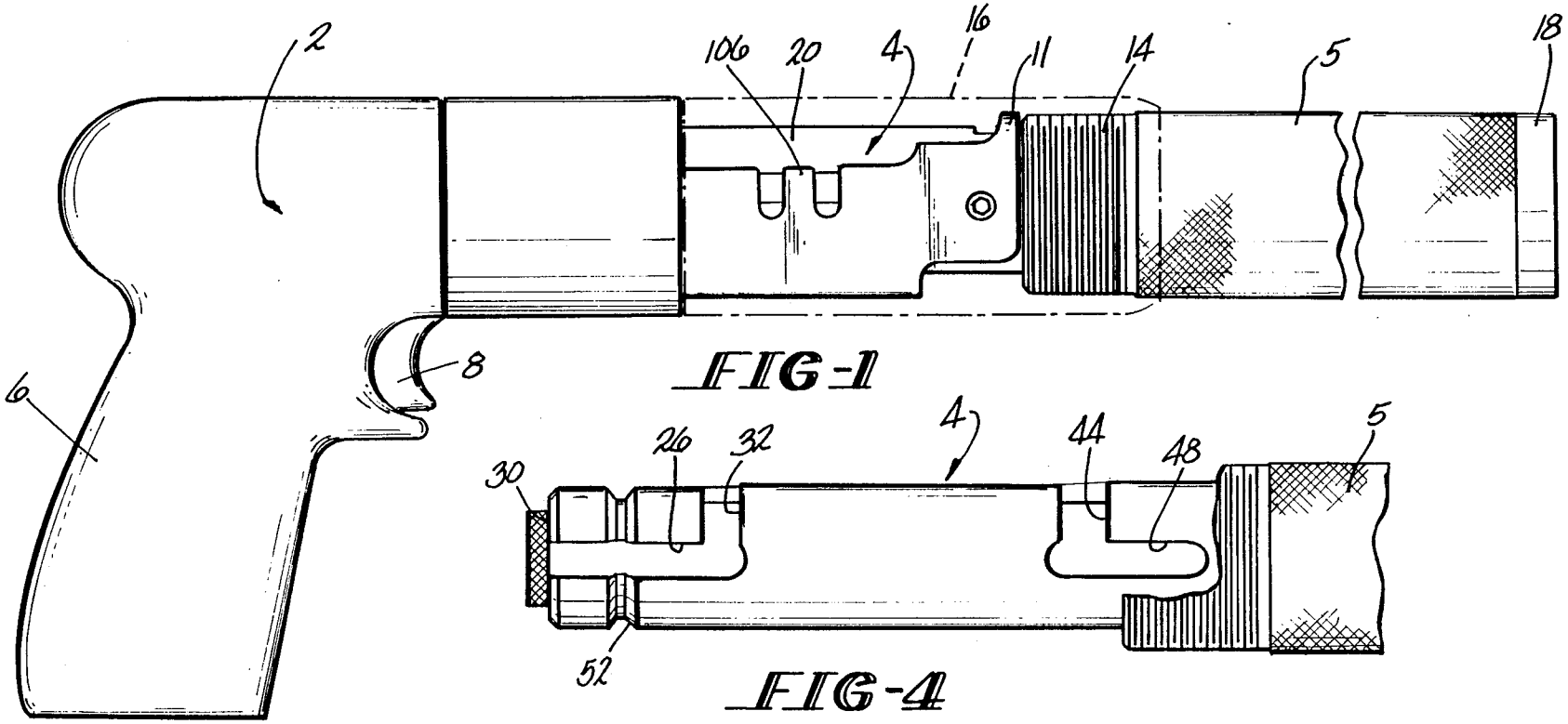
FIG-1
FIG-4
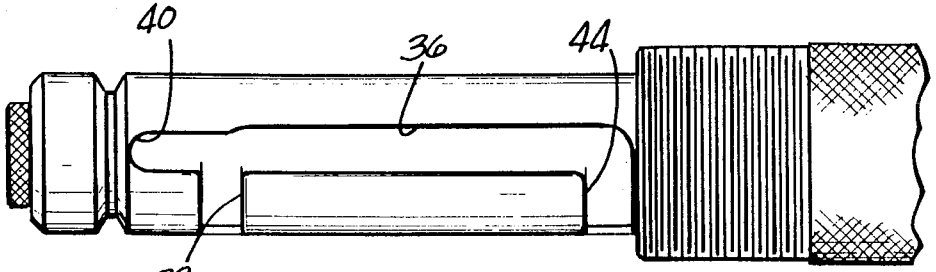
FIG-6
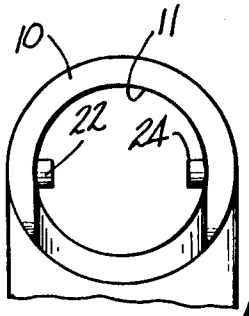
FIG-3

60
64
66
68
70
74
62

4
11
52
10
106

109
111
113
4

5
111
105
107
16
4

5
4
16
20

PIVOT-LOAD POWDER ACTUATED TOOL WITH FIRING CHAMBER INSERT

This invention relates to a powder actuated tool for driving elongated members into supporting surfaces, such as concrete. More particularly, this invention relates to a tool which may be used for driving a compression measuring probe into a concrete substrate in the general manner disclosed in U.S. Pat. No. 3,732,725, issued May 15, 1973 to R. J. Kopf et al.

Tools for driving elongated members into supporting surfaces and which are operated by firing a round of blank ammunition are generally old in the art. Such tools generally include a housing member on which the handle is usually located and in which a trigger operated firing mechanism is housed. A barrel assembly is usually reciprocally mounted on the housing member for movement between a breech open position and a breech closed position. The member to be driven is placed in the bore of the barrel assembly and a blank cartridge is loaded into a firing chamber which is generally in the breechward end of the barrel assembly. The barrel is then moved to its breech closed position and the muzzle of the tool is pushed against the surface into which the member is to be driven. This cocks the firing mechanism which is then actuated by pulling the trigger of the tool.

The above generally described tools can be low power tools, high power tools, or have means for varying the power of the tool. The low power tools may have a ram member movably mounted in the barrel bore for driving the member from the muzzle of the tool and will usually fire a 22 caliber blank cartridge. With such a low power tool, there is no need to provide a direct physical interlock between the breech block and the breechward end of the barrel where the firing chamber is located. The high power tools, such as that shown in U.S. Pat. No. 3,732,725 will fire higher caliber ammunition, such as 32 caliber blanks, whereby those skilled in the art, to date, have provided a direct mechanical interlock between the breech block and the breechward end of the barrel assembly, such as the interrupted threads which are shown in the U.S. Pat. No. 3,732,725. As with all modern manufacture, it is desirable that all parts for the tools be interchangeable so that a new barrel, or a new breech block can be fitted onto a used tool with minimal problems. The use of the mechanical interlock between the breech block and the breechward end of the barrel in the high power tool makes it difficult and expensive to achieve the desired degree of interchangeability of these threaded parts due to wear on the interrupted threads of the tools in use. They tend to become mated counterparts which are not readily compatible with newly machined threads on replacement parts.

The tool of this invention overcomes the above-noted problem of replacement parts by eliminating the direct mechanical interlock between the breech block and the breechward end of the barrel. The barrel assembly of the tool of this invention is connected to the tool housing by a pair of lugs which are mounted on the muzzle end of the housing, which lugs extend into slots formed in the exterior of the barrel assembly. The lugs-slots combination allows the barrel assembly to be reciprocated between its breech open and breech closed positions. The slots include longitudinal slots on the barrel assembly which allow the longitudinal movement of the barrel assembly and, also, include circumferential slots which allow the barrel assembly to be twisted when in its breech closed position, whereby it will be held in its breech closed position. The barrel assembly can also be completely separated from the housing for cleaning, etc. The firing chamber of the tool is a separate piece which is telescoped into the breech end of the barrel bore and can be readily removed therefrom. Gas grooves are formed on the exterior of the firing chamber member to retard breechward movement of the firing chamber member when the tool is fired. The firing mechanism is of the same general type as that shown in application Ser. No. 394,684, filed July 2, 1982 to R. J. Kopf, now U.S. Pat. No. 4,493,376. The tool is cocked in the same general manner as disclosed in U.S. Pat. No. 3,732,725.

It is, therefore, an object of this invention to provide an improved powder actuated tool which can fire high power loads to perform work.

It is an additional object of this invention to provide a tool of the character described which has a barrel assembly reciprocally slidably mounted on a housing assembly.

It is a further object of this invention to provide a tool of the character described which displays improved interchangeability of parts.

It is an additional object of this invention to provide a tool of the character described which does not include a direct mechanical interlock between the breech block and the breech end of the barrel assembly.

These and other objects and advantages of this invention will become more readily apparent to those skilled in the art from the following detailed description of a preferred embodiment of the tool when taken in conjunction with the accompanying drawings, in which:

FIG. 1 is a fragmented side elevational view, partially in phantom, of a preferred embodiment of a tool formed in accordance with this invention;

FIG. 3 is an elevational view of the muzzle end of the housing member;

FIG. 4 is a fragmented elevational view of one side of the barrel assembly;

FIG. 6 is a fragmented plan view of the top of the barrel assembly;

Figures 2, 8, 9, 14, 15:
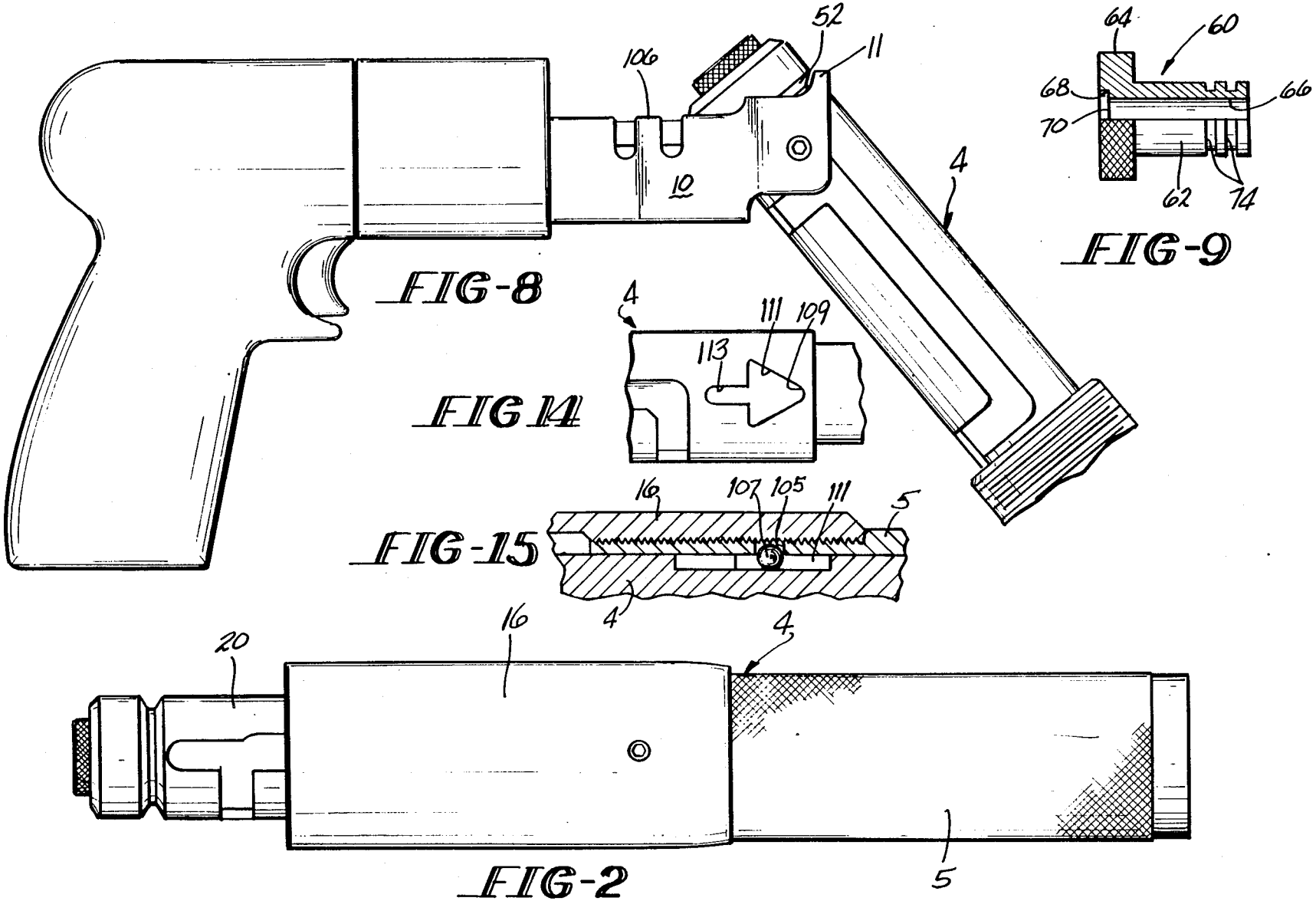
FIG. 2 is a side elevational view of the barrel assembly of the tool disconnected from the housing member.
FIG. 8 is a fragmented side elevational view of the tool showing the barrel in its breech open condition whereby the tool can be loaded or unloaded.
FIG. 9 is a side elevational view partly in section, of the firing chamber member of the tool.
FIG. 14 is a plan view of the barrel member showing an alternative form of air fire prevention slot.
FIG. 15 is a fragmented sectional view showing the connection between the barrel, shroud and cover at the air fire prevention slot.

Referring now to the drawings, the tool includes a housing member denoted generally by the numeral 2 and a barrel assembly denoted generally by the numeral 4. The housing 2 includes a handle 6, carries a trigger 8, and includes a muzzleward cradle portion 10. The barrel assembly is housed in a shroud 5, onto a threaded portion 14 of which there is screwed a cover 16 (shown in phantom). The muzzle of the barrel assembly 4 is at 18. The barrel assembly 4 also includes a breechward portion 20 which is telescoped into the cradle portion 10 of the housing 2.

The housing cradle 10 includes a pair of lugs 22 and 24 which are screwed into the side walls of the cradle 10 and project toward each other as shown in FIG. 3. The breechward portion 20 of the barrel assembly 4 includes a plurality of slots formed in its outer surface, which slots are most clearly shown in FIGS. 4–7. The slots include entry slots 26 and 28 formed on opposite sides of the barrel assembly 4 and opening through the breechward face 30 of the barrel assembly 4. The entry slots 26 and 28 communicate with breechward circumferential slots 32 and 34 respectively. The breechward circumferential slots 32 and 34 extend through an approximate 90° angle of the circumference of the barrel assembly 4 where they merge into a pair of longitudinal slots 36 and 38. The slots 36 and 38 include closed ended breechward portions 40 and 42 respectively. The slots 36 and 38 extend muzzleward for a predetermined distance where they merge with muzzleward circumferential slots 44 and 46 which extend through approximately a 90° angle to merge into relatively short longitudinal slots 48 and 50 respectively. An annular groove 52 is formed in the barrel assembly 4 near the breechward end thereof. To mount the barrel assembly 4 in the housing 2, the lugs 22 and 24 are inserted into the entry slots 26 and 28 respectively, and the barrel assembly is pushed breechward into the housing cradle 10. When the lugs 22 and 24 reach the breechward circumferential slots 32 and 34, the barrel assembly 4 is twisted in the clockwise direction to bring the lugs 22 and 24 into the longitudinal slots 36 and 38. If one desires to then open the breech, the barrel assembly 4 is moved muzzleward to slide the lugs 22 and 24 into the closed ended portions 40 and 42 of the slots 36 and 38. The barrel assembly 4 is then pivoted to the position shown in FIG. 8 whereupon the breech end of the barrel assembly 4 is presented for loading or unloading the tool. The circumferential groove 52 is engaged by the U-shaped upper part 11 of the cradle 10 to hold the barrel assembly in place in the loading position.

To move the barrel assembly 4 to its breech closed position, which is shown in FIG. 1, the lugs 22 and 24 are moved through the longitudinal slots 36 and 38 until the lugs 22 and 24 reach the muzzleward circumferential slots 44 and 46. The barrel assembly 4 is then twisted in the counter-clockwise direction until the lugs 22 and 24 register with the short longitudinal slots 48 and 50. The slots 48 and 50 allow the housing 2 and lugs 22 and 24 to slide muzzleward over the barrel assembly 4 when the tool is pushed down to cock the firing mechanism. It is noted that the barrel assembly 4 is telescopingly mounted in the barrel assembly shroud 5 with the barrel assembly shroud 5 being biased in a breechward direction with respect to the barrel assembly 4. Thus, when the tool is pushed down to cock the firing mechanism, the housing cradle 10 pushes the shroud 5 muzzleward over the barrel assembly 4. The housing 2 thus is able to slide muzzleward over the barrel assembly 4. After the pushing pressure is removed, the shroud 5 automatically moves breechwardly under the influence of the bias, and the lugs 22 and 24 are returned to the breechward ends of the slots 48 and 50.

Figures 5, 7, 10, 11, 12, 13:
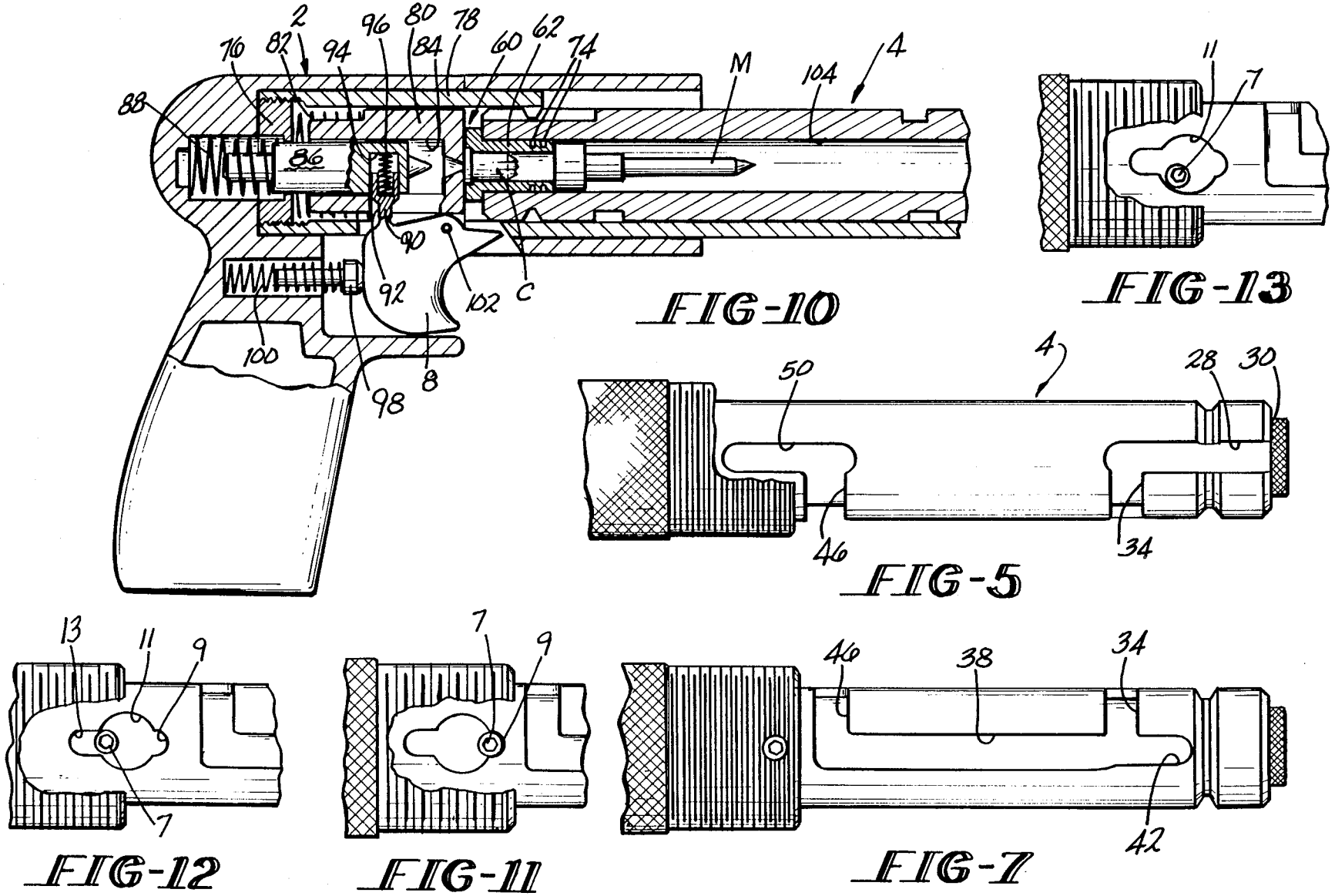
FIG. 5 is a fragmented elevational view of the side of the barrel opposite, that shown in FIG. 4.
FIG. 7 is a fragmented plan view of the bottom of the barrel assembly.
FIG. 10 is a fragmented side sectional view of the breech end of the tool showing a member to be driven in place in the barrel bore and showing a cartridge chambered in the firing chamber.
FIG. 11 is a fragmented elevational view broken away showing the mode of attachment of the barrel and the shroud.
FIG. 12 is a view similar to FIG. 11 but showing the detail as it appears when the tool is pushed down, cocked, and ready to fire.
FIG. 13 is a view similar to FIG. 12 but showing the detail as it would appear were one to attempt to air fire the cocked tool.

Referring to FIGS. 11–13, the manner in which the shroud 5 is mounted on the barrel 4 for the reciprocal movement is illustrated. A set screw 7 is screwed into a threaded bore in the shroud 5 and extends into a slot formed in the exterior of the barrel 4. The slot includes a breechward recess 9 into which the set screw 7 nests when the tool is not cocked. When the tool is cocked, the set screw 7 moves muzzleward toward a recess 13 which allows for recoil of the barrel when the tool is fired. The position of the set screw 7 at full pushdown when the tool is cocked and ready to be fired is shown in FIG. 12. It is noted that were the slot restricted laterally throughout its entire extent, it would be possible to cock the tool by pushdown, twist the shroud 5 to jam the set screw 7 in the slot, and then lift the tool off the push down surface and air fire it. To prevent this from occurring, an enlarged medial portion 11 is formed in the slot. If one were to attempt to twist the shroud 5 at push down, the set screw 7 will ride along the edge of the enlarged portion 11 of the slot as shown in FIG. 13. This will cam the barrel muzzleward and thus move the breechblock and firing pin muzzleward out of the cocked position. Thus, the tool cannot be air fired. After firing, the tool breech is opened by twisting the barrel assembly 4 in a clockwise direction and sliding the barrel assembly muzzleward to the position shown in FIG. 8. Once the lugs 22 and 24 reach the breechward ends of the closed slots 40 and 42, the barrel assembly will pivot down to the position shown in FIG. 8. If one desires to dismantle the tool, upon reaching the slots 32 and 34, the barrel assembly is twisted in the counter-clockwise direction and the lugs 22 and 24 are pulled out through the slots 26 and 28.

FIGS. 14 and 15 illustrate an alternative somewhat lower cost mechanism for connecting the barrel 4, the shroud 5 and the cover 16 together while preventing air fire of the tool. The barrel 4 is provided with a slot having a muzzleward restricted end portion 109, a medial outwardly tapering portion 111, and a breechward elongated restricted portion 113. It will be noted that the slot has the general shape of an arrowhead which points toward the muzzle of the barrel 4. A through hole 105 is drilled in the threaded portion of the shroud 5 and the barrel 4 is inserted into the shroud 5 so that the hole 105 overlies the slot 111. A steel ball 107 is then inserted into the hole 105 whereupon the ball 107 drops into the slot 111 and extends up into the hole 107. The cover 16 is then screwed onto the shroud 5 so as to overlie the hole 105 and ball 107, as shown in FIG. 5. The steel ball 107 serves as a connection between the barrel 4 and shroud 5, and also cooperates with the slot 111, in the same manner as previously described with respect to the set screw 7, to prevent air fire of the tool.

Referring now to FIGS. 5, 9 and 10, details of the firing mechanism and firing chamber are shown. The firing chamber, denoted generally by the numeral 60, is generally tubular in configuration and includes a reduced diameter shank 62 and an enlarged diameter head 64. A through bore 66 is provided with a counter bore 68. A center fire cartridge placed in the chamber 60 has its rim seated against the flange 70 formed by the counter bore 68. A pair of gas turbulence sealing grooves 72 are formed on the exterior of the firing chamber shank 62. The exterior of the firing chamber head 64 is knurled for ease of grasping.

Referring now to FIG. 10, the tool is shown in its cocked, ready to fire position. The firing mechanism in the tool housing 2 includes a base ring 76 which is bolted into the housing and onto which is threaded a sleeve 78. A breech block 80 is slidably mounted in the sleeve 78 and is biased in the muzzleward direction by a spring 82. The breech block 80 includes a bore 84 in which is mounted a firing pin 86 which is biased in the muzzleward direction by a firing pin spring 88. A surface 90 on the breech block 80 forms a sear which engages the firing pin pawl 92. The pawl 92 is mounted in a well 94 in the firing pin 86 and is biased toward the trigger 8 by a spring 96. The trigger 8 is engaged by a spring finger 98 which is biased by a spring 100 so as to bias the trigger 8 in a counter-clockwise direction about a pin 102.

The tool is loaded as follows. The tool is opened to the position shown in FIG. 8 and the firing chamber 60 is removed from the barrel bore 104. A fastener, probe, or other member to be driven M is then inserted into the barrel bore 104 through the breechward end thereof. A cartridge C is then placed in the firing chamber 60 and the firing chamber 60 is reinserted into the barrel bore 104 behind the fastener or the like M. When the firing chamber 60 is pushed into the barrel bore 104 and is seated therein, the chamber 60 pushes the fastener M muzzleward to the proper position. The barrel 4 is then returned to its breech closed position and the tool is pressed against the surface into which the member M is to be driven. This causes the barrel 4 to move deeper into the housing 2 and causes the breech block 80 to move against the bias of the spring 82 and the firing pin 86 to move against the bias of the firing pin spring 88. When the tool reaches the position shown in FIG. 10, the trigger 8 is pulled to fire the cartridge C. The member M is thus propelled by expanding combustion gases through the barrel bore 104. As the combustion gases leave the muzzleward end of the firing chamber 60 to drive the member M, they also enter the grooves 74 in the exterior of the firing chamber stem 62. This causes the firing chamber 60 to lock up in the barrel bore 104 and prevents the firing chamber 60 from being propelled breechward with respect to the barrel 4. This also prevents gas from leaking out between the firing chamber 60 and the barrel bore 104 in a breechward direction. The effect is that the breech block 80 is not displaced in the breechward direction against the bias of the spring 82 despite the fact that there is no direct mechanical interlock between the barrel 4 and the breechblock 80. Repeated tests have shown that when a cartridge is fired, the firing chamber 60 will move breechward an infinitesimal distance until the combustion gases can get to the grooves 74, at which time, breechward movement of the firing chamber 60 stops.

To reload the tool, the barrel 4 is returned to the position shown in FIG. 8, the firing chamber 60 is removed from the barrel bore 104 and the muzzle end of the firing chamber 60 is telescoped over an extractor finger 106 on one side of the housing cradle 10. The finger 106 enters the bore 66 of the firing chamber 60 sufficiently to dislodge the fired cartridge case from the firing chamber 60. A new member M is then inserted into the barrel bore 104, a fresh cartridge is inserted into the firing chamber 60, and the cartridge chamber 60 is inserted into the barrel bore 104, whereupon the aforesaid firing procedure is repeated.

It will be readily appreciated that the features of the tool of this invention can be used in a variety of applications. When the tool is used to set fasteners, it can be used with a muzzle bushing. When it is used to drive compression probes, as set forth in aforesaid U.S. Pat. No. 3,732,725, it can be used with a template as shown in that patent. The tool could also be used for other power applications which require firing of blank cartridges to perform work. The overall construction of the tool is desirable for low cost manufacture. The manner in which the barrel is mounted on the housing provides reliable operation, with notable durability. Individual parts can be replaced without tolerance problems. The use of the gas lock-up for the removable firing chamber greatly reduces the interfitting problems which are found when trying to replace an interlocking barrel-breech block with one new part while retaining the other used part.

Since many changes and variations of the disclosed embodiment of the invention may be made without departing from the inventive concept, it is not intended to limit the invention otherwise than as required by the appended claims.

What is claimed is:

1. A powder actuated tool comprising:

(a) a housing member;

(b) a breech member mounted in said housing member;

(c) lug means on said housing member; and (d) a barrel assembly mounted on said housing member, said barrel assembly including first longitudinal slot means receiving said lug means and enabling longitudinal movement of said barel assembly between breech open and breech closed positions, and said barrel assembly further including first circumferential slot means communicating with said first longitudinal slot means enabling said barrel assembly to be rotated about its axis when disposed in said breech closed position, said first longitudinal slot means having a closed breechward end for receiving said lug means when said barrel assembly is in a breech open position and providing a pivot stop whereby said barrel assembly can be pivoted about said lug means to a cartridge loading and unloading position, and said barrel assembly also comprising cocking slot means communicating with said first circumferential slot means and providing means for receiving said lug means during cocking movement of said barrel assembly against said breech member.

2. The tool of claim 1 wherein said barrel assembly further comprises second circumferential slot means on said barrel assembly communicating with said first longitudinal slot means breechward of said first circumferential slot means, and second longitudinal slot means communicating with said second circumferential slot means and opening through a breechward end of said barrel assembly, said second circumferential slot means and said second longitudinal slot means providing means whereby said barrel assembly can be engaged with and disengaged from said lug means and said housing member.

3. The tool of claim 1 wherein said housing member comprises a stop surface operable to engage said barrel assembly to hold said barrel assembly in its catradge loading and unloading position.

4. The tool of claim 3 wherein said barrel assembly includes a recessed portion in its outer surface operable to engage said housing member stop surface to increase the available pivot angle for said barrel assembly.

5. A powder actuated tool comprising:

(a) a housing member;

(b) a barrel assembly mounted on said housing member for reciprocal movement between breech open and breech closed positions, said barrel assembly having a bore with a muzzleward end and a breechward end;

(c) a breech block assembly mounted in said housing member, said breech block assembly being slidable in said housing member and spring biased toward the tool muzzle, said breech block assembly including a breech face;

(d) a firing chamber member slidably mounted in the breechward end of said barrel assembly bore, said firing chamber member having a shank portion extending into said barrel assembly bore, said firing chamber member shank portion having at least one circumferential empty turbulence gas sealing groove formed on the outer surface thereof proximate the muzzleward end of said firing chamber member, said gas sealing groove providing means for preventing substantial breechward movement of said firing chamber member with respect to said barrel assembly when a cartridge is fired in said tool.

6. The tool of claim 5 wherein said barrel assembly and said breech block assembly are devoid of any direct mechanical interlocking mechanism which physically connects the two together.

7. The tool of claim 5 wherein said firing chamber member shank portion has a pair of circumferential empty gas sealing grooves formed therein.

8. The tool of claim 5 wherein said housing member includes a muzzleward cradle portion for telescopingly receiving said barrel assembly, said cradle portion having side walls, one of which includes an extractor finger portion which is operable to telescope into said firing chamber member to extract a fired cartridge case therefrom upon removal of said firing chamber member from said barrel assembly bore.

9. The tool of claim 5 wherein said firing chamber member includes a radially enlarged head portion breechward of said shank portion, said head portion having a muzzleward face for engaging a breechward end of said barrel assembly and a breechward end for engaging said breech block assembly breech face.

10. The tool of claim 5 wherein said firing chamber member head portion has a knurled circumferential outer surface to facilitate grasping for manual removal of said firing chamber member from said barrel assembly bore.

11. A powder actuated tool comprising:

(a) a housing member including a handle portion and a muzzleward cradle portion; (b) a breech block reciprocally slidably mounted in said housing member;

(c) a barrel assembly mounted in said housing member for reciprocal movement between a breech closed position and a breech open position, said barrel assembly including a bore extending therethrough;

(d) lug means disposed in said housing member cradle portion;

(e) slot means disposed in the outside surface of said barrel assembly, said lug means being slidably disposed in said slot means, said slot means including longitudinal slots for providing longitudinal sliding movement of said barrel assembly with respect to said housing member, and circumferential slots for providing axial twisting movement of said barrel assembly with respect to said housing member; and (f) a tubular firing chamber member slidably mounted in a breechward end of said barrel assembly bore, said firing chamber member comprising a shank portion extending into said barrel bore with said shank portion having a substantially smooth exterior surface save for empty gas turbulence sealing groove means disposed on said firing chamber member shank exterior surface proximate the muzzleward end of said firing chamber member, said sealing groove means being operable to prevent substantial breechward movement of said firing chamber member with respect to said barrel assembly when a cartridge is fired in said tool, said firing chamber member contacting said breech block when said barrel assembly is in said breech closed position, and said barrel assembly being free of direct mechanical connection with said breech block.

12. The tool of claim 11 wherein said firing chamber member includes an enlarged head portion having a muzzleward face which contacts the muzzleward end of said barrel assembly and a breechward end which engages said breech block when said barrel assembly is in said breech closed position.

13. The tool of claim 11 wherein said sealing groove means comprises a pair of empty grooves formed circumferentially on said firing chamber member shank portion.

14. The tool of claim 11 wherein said housing member cradle includes a side wall having an extractor finger formed thereon, said extractor finger being operable to telescope into said firing chamber member when the latter is removed from said barrel assembly bore to extract a fired cartridge case from said firing chamber member.

15. The tool of claim 11 wherein said barrel assembly longitudinal slots include a pair of longitudinal slots operable to receive said lug means during reciprocation of said barrel assembly between said breech open and said breech closed positions, and said circumferential slots include a set of muzzleward circumferential slots communicating with said pair of longitudinal slots to receive said lug means when said barrel assembly is twisted to retain said barrel assembly in said breech closed position.

16. The tool of claim 17 wherein said barrel assembly longitudinal slots includes a set of entry slots positioned breechwardly of said barrel assembly and opening through the breechward face of said barrel assembly, and said circumferential slots include a pair of breechward circumferential slots communicating with said entry slots and with said pair of longitudinal slots, said breechward circumferential slots and said entry slots providing a path through which said lug means can be moved to and from said pair of longitudinal slots to connect and disconnect said barrel assembly and said housing member.

17. The tool of claim 15 wherein said pair of longitudinal slots includes breechward closed end portions operable to receive said lug means when said barrel assembly is in said breech open position to provide pivots for said barrel assembly whereby said barrel assembly can be pivoted about said lug means when in said breech open positon to present said firing chamber for loading and reloading of said tool.

18. The tool of claim 17, wherein said housing member cradle includes an upper stop wall portion muzzleward thereof, and said barrel assembly includes a groove formed in its external surface breechward thereof, said stop wall portion entering said groove when said barrel assembly is pivoted about said lug means to retain said barrel assembly in said breech open position.

19. A powder actuated tool comprising:

(a) a housing;

(b) a barrel mounted in said housing for reciprocal movement between a breechward cocked position and a muzzleward uncocked position;

(c) a shroud mounted on said barrel;

(d) means biasing said barrel in the muzzleward direction with respect to said shroud;

(e) securement means interconnecting said shroud and said barrel, said securement means comprising a slot formed in the exterior surface of said barrel and a stop mounted in said shroud and extending into said slot, said stop being reciprocally slidable in said slot during reciprocal movement of said barrel in said shroud, said slot including a medial enlarged portion providing a camming surface for engaging said stop upon twisting of said shroud with respect to said barrel when said barrel is in said cocked position, said stop being operable upon engagement with said camming surface to cam said barrel in the muzzleward direction and out of said cocked position to prevent air fire of the tool.

20. The tool of claim 19, wherein said stop comprises a set screw mounted in said shroud and extending into said slot.

21. The tool of claim 19, wherein said stop comprises a ball disposed in a through passage in said shroud and extending into said slot, and a cover secured to said shroud and overlying said ball to retain the latter in said through passage.

* * * * *